US007250566B2

(12) United States Patent
Lengeling et al.

(10) Patent No.: US 7,250,566 B2
(45) **Date of Patent: *Jul. 31, 2007**

(54) EVALUATING AND CORRECTING RHYTHM IN AUDIO DATA

(75) Inventors: Gerhard Lengeling, Los Altos, CA (US); Sol Friedman, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/497,867

(22) Filed: Aug. 1, 2006

(65) Prior Publication Data

US 2006/0272485 A1 Dec. 7, 2006

Related U.S. Application Data

(63) Continuation of application No. 10/805,451, filed on Mar. 19, 2004, now Pat. No. 7,148,415.

(51) Int. Cl.
*G10H 1/40* (2006.01)
*G10H 7/00* (2006.01)

(52) U.S. Cl. ..... 84/611

(58) Field of Classification Search ..... 84/611, 84/635, 651, 667
See application file for complete search history.

(56) References Cited

U.S. PATENT DOCUMENTS

| | | | |
|---|---|---|---|
| 6,316,712 | B1 | 11/2001 | Laroche |
| 6,323,412 | B1 | 11/2001 | Loo |
| 6,469,240 | B2 | 10/2002 | Pachet et al. |
| 6,618,336 | B2 | 9/2003 | Kanou et al. |
| 6,812,394 | B2 | 11/2004 | Weissflog |

*Primary Examiner*—Jeffrey W Donels
(74) *Attorney, Agent, or Firm*—Hickman Palermo Truong & Becker LLP

(57) ABSTRACT

The invention is directed to a method and apparatus for evaluating and correcting rhythm of audio data. Embodiments of the invention are capable of obtaining preferred rhythm in audio data, and strategically correcting the portions of audio data resulting an enhancing rhythm. A system embodying the invention may detect each transient in audio data, compute an ideal time for the transient and determine the time deviation from the expected ideal time. The system may correct for the time of the transient by altering the audio data before or after the transient. The system utilizes one or more methods to correct for the timing while preserving the audio quality of the signal.

69 Claims, 6 Drawing Sheets

EVALUATING AND CORRECTING RHYTHM IN AUDIO DATA

FIELD OF THE INVENTION

This application is a continuation of U.S. patent application Ser. No. 10/805,451 filed Mar. 19, 2004 now U.S. Pat. No. 7,148,415 which is incorporated herein by reference in its entirety.

BACKGROUND

This invention relates to the field of computer software. More specifically, the invention relates to software for processing audio data. A portion of the disclosure of this patent document contains material to which a claim to copyright is made. The copyright owner has no objection to the facsimile reproduction by anyone of the patent document or the patent disclosure, as it appears in the Patent and Trademark Office file or records, but otherwise reserves all other copyright rights whatsoever.

BACKGROUND

Time and Pitch are fundamental components of music. Rhythm is concerned with the relative duration of pitch and silence events in time. In fact, the quality of a music performance is largely judged by how well a performer or group of performers keep the time. In music compositions, time is divided into intervals that the musician follows when playing music notes. The closer the onset of the notes to the beginning of a time interval, or to a subdivision thereof, the more agreeable the music sounds to the human ear. In order to learn to keep time, musicians use a time keeping device, such as a metronome while playing music. With practice, skilled performers are able to play notes in relative timing with each metronome tick. However, in other cases the performer may keep an average time over the length of a performance, whereas the notes may individually deviate from each expected ideal tick, this is known as rubato. The human ear is sensitive to even small deviations in time and is able to judge the quality of the performance due to these deviations.

Modern digital data processing applications offer tools to correct or enhance audio data. These applications are capable of reducing background noise, enhancing stereo effects, adding or removing echo effects or performing other such enhancements to the audio data. However, these existing applications do not provide a mechanism for correcting inaccurate rhythm events in the audio data. Because of this and other limitations inherent in the prior art, there is a need for a process that can reduce rhythmic deviations in audio data.

Embodiments of the invention provide a mechanism for enhancing the rhythm of an audio data stream or audio stream for short. For instance, systems adapted to implement the invention are capable of enhancing rhythm in audio data by obtaining the underlying rhythm information, determining for each audio data event an ideal time, and correcting significant deviations from the ideal time.

Audio data waveforms generally show periods of relatively low amplitude and periods of high amplitude. Transient events occur between relatively low amplitude and high amplitude audio waveform portions of the audio data and generally correspond to beats in the music that are expected to occur at regular intervals. The relation of these events in time has a significant impact upon the quality of the performance. Embodiments of the invention detect deviations from an ideal time for each event and alter the timing of each transient event to achieve this ideal timing.

Embodiments of the invention may utilize a conversion function to represent the energy in audio signal. From an audio energy viewpoint, transients are regions where the energy abruptly increases. By detecting local increases of energy, an embodiment of the invention is able to detect each transient and determine a number of timing parameters for each transient. For example, the system may determine the time at which a transient reaches a given threshold level, the time the transient reaches a local peak, the time of the onset of the transient, and any other time related information that may be garnered from the audio signal.

Embodiments of the invention compare one or more time references for each transient with time data of an ideal time event (that may for example correspond with a time tick of a metronome) and compute a deviation between the occurrence of the transient and its expected ideal time. A determination as to whether to correct the deviation may then be made based on one or more correction criteria.

The system may apply one or more techniques for correcting time deviations. In one embodiment of the invention, when the transient is to be moved to an earlier point in time, the system may compress one or more portions of the audio data ahead of the transient. In the case when a transient is to be delayed, the system may expand audio data ahead of the transient in question.

Expansion and compression by inserting and deleting audio data may lead to unpleasant sound effects which are known as artifacts. Embodiments of the invention employ methods for manipulating the audio data either by introducing no artifacts or by applying further methods to remove the artifacts. To this end, embodiments of the invention may utilize cross-fading methods to correct for transitions between segments after a portion of the audio data has been removed, which may have created discontinuities in the signal. In other cases where a portion of the audio data is to be expanded, an embodiment of the invention may utilize cross-fading among a number of successive segments to achieve expansion without introducing a repetitive pattern that may be detected by the human ear and judged unpleasant.

By obtaining a preferred rhythm for a performance, detecting an ideal time for each transient and correcting significant deviations from the ideal time, embodiments of the invention provide a powerful tool to enhance music quality as perceived by the human ear.

DETAILED DESCRIPTION

Embodiments of the invention are directed to a method and apparatus for evaluating and correcting rhythm in audio data. One or more of these embodiments may be implemented in computer program code configured to analyze audio data to obtain rhythm information, determine for each transient event in the audio data an ideal time and correct for deviations from the ideal time.

In the following description, numerous specific details are set forth, to provide a more thorough description of the invention. It will be apparent, however, to one skilled in the art, that the present invention may be practiced without these specific details. In other instances, well known features have not been described in detail so as not to obscure the present invention. The claims, however, are what define the metes and bounds of the invention.

Audio data is any type of sound related data generated through a sound system such as but not limited to a microphone, the output of a recording or playing system or any type of device capable of generating audio data. Audio data may be in the form of analog data such as data generated by a microphone, or data that is digitized through a conversion of analog-to-digital data and stored in a computer file. Audio data may be stored in and retrieved from a storage medium (e.g. a computer hard drive, a compact disk, a magnetic tape or any other data storage device), or from a stream of data such as a network connection.

Figure 1:
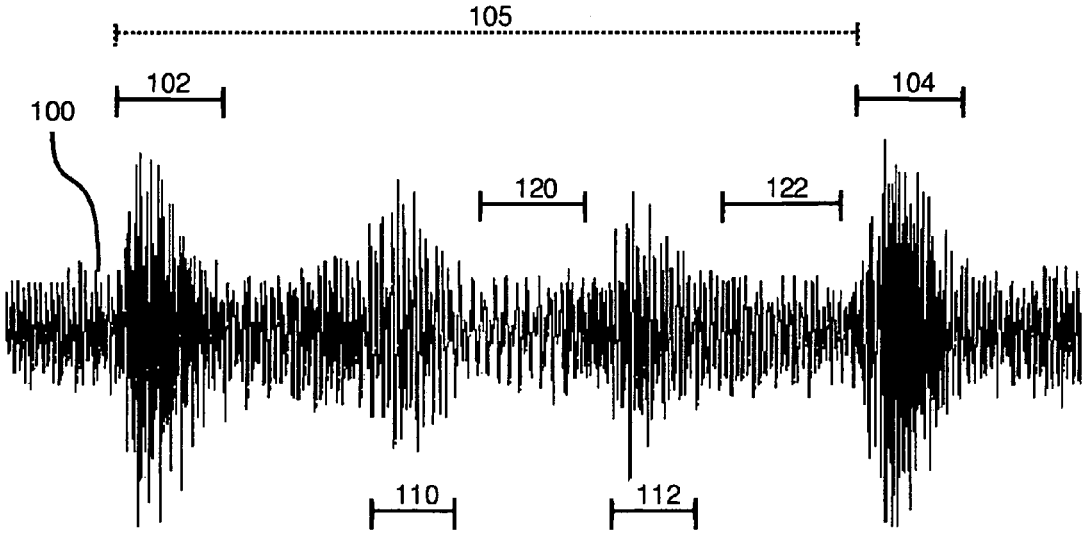
FIG. 1 illustrates an audio waveform that represents an example of typical audio data input for embodiments of the invention.

FIG. 1 illustrates an audio waveform that represents audio data as processed by embodiments of the invention. Waveform 100 represents a few seconds of a typical audio data from a music recording. Waveform 100 is shown with the amplitude of the sound drawn in the vertical axis and time displayed in the horizontal axis. The waveform 100 is generally characterized by transients (e.g. 102, 104, 110 and 112) representative of one or more instruments that keep a rhythmic beat at regular intervals (e.g. 105).

Regions 102 and 104 may represent two (2) successive beats. The beats (or transients) and are generally characterized by a noticeable high amplitude (or energy), and a more complex frequency composition. Between beats, the waveform shows regions of a steadier activity such as 120 and 122, or other lower-energy beats (e.g. 110 and 112).

Embodiments of the invention described herein evaluate and correct rhythm in audio data by manipulating audio data having transients caused by rhythmic beats. However, it will be apparent to one with ordinary skills in the art that embodiments of the invention may utilize similar methods for analyzing voice data, or audio data from any other source.

Embodiments of the invention may calculate the timing of transients to automatically detect a rhythm. By measuring a time occurrence for each transient, a calculation of the periodicity that characterizes the inter-transient time may be generated. The system may, for example, compute the average time separating transients and analyze the statistical distribution of intertransient time to determine the times of notes and their sub-divisions (e.g. halfnotes, quarter-notes, eighth-notes, etc.). Based on the calculations, an embodiment of the invention is capable of automatically computing rhythm parameters for the audio data including the preferred rhythm. Using the computed rhythm parameters, the system may then compute for any transient in an audio stream, the ideal expected time of occurrence. In other embodiments the invention, the system may obtain the rhythm information from a data set comprising user input or a data file.

Figure 2A:
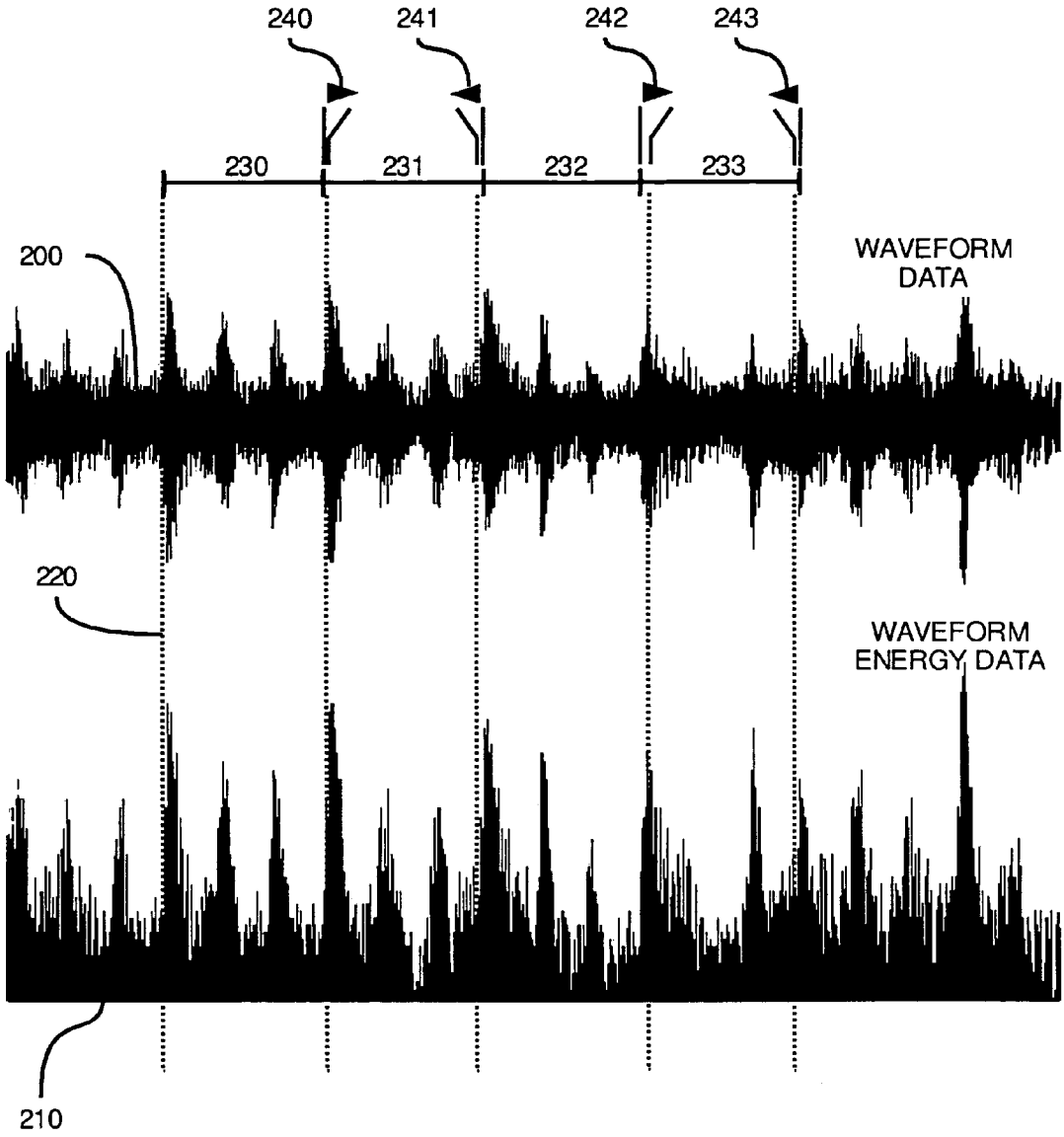
FIG. 2A shows plots of the waveform of an audio data segment and its local energy representation as processed by an embodiment of the invention.

FIG. 2A shows plots of the waveform of an audio data segment and its local energy representation as processed by an embodiment of the invention. Plot 200 shows a segment of audio data similar to plot 100 of FIG. 1, which is represented at a lower time resolution to show time repeated transients.

Segments 230, 231, 232 and 233 represent time intervals as would correspond to tick of a metronome for example.

Plot 210 represents the energy contained in the audio signal, again with time increasing in the horizontal axis, but rather with power displayed in the vertical axis as opposed to amplitude as shown in the waveform data plot. In this example, the system computes the energy using the absolute value of the amplitude. However, an embodiment of the invention may utilize any available method to compute signal energy. Other methods that may be used are the square of the amplitude of each data point, local average (or weighted average) of a number of consecutive data points or any other available method for computing energy.

The system may utilize the energy data to provide a variety of information about the waveform data. For example, the system may accurately detect transients and regions of lower activity by comparing energy levels in the energy data with a given threshold. More importantly, embodiments of the invention are capable of detecting the timing error between each transient and a measured or ideal computed time that would correspond for example to a metronome tick (e.g. ticks between time intervals 230, 231, 232 and 233). The timing errors represented by arrowheads 240, 241, 242 and 243 each is a measure of the time between a metronome tick and a transient, which may be represented by a positive or a negative number to indicate a delay or a early rise of a transient, respectively.

Embodiments of the invention provide a method for detecting and correcting timing errors between transients and a reference tick from a time source. Furthermore, embodiments of the invention provide methods for obtaining the time periods in which the transients may be expected to lock. An embodiment of the invention may obtain the time information from a time source, may use the signal information to obtain timing information of transients and may correct individual timing errors. By analyzing the energy data, embodiments of the invention are capable of detecting regions of audio data that lend themselves to data manipulation while minimizing audible (or unpleasant) artifacts. In the example of FIG. 1, segments 120 and 122 may be suitable for using cross-fading techniques to obtain a timing correction in accordance with embodiments of the invention.

Figure 2B:
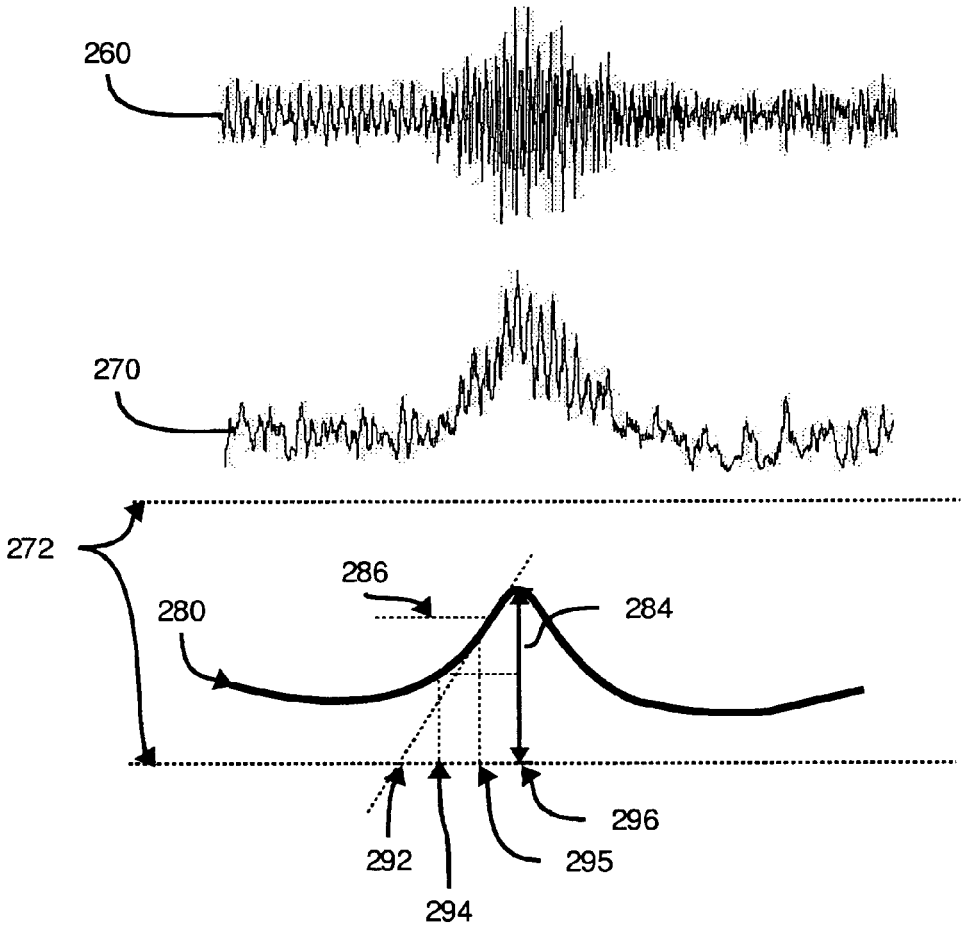
FIG. 2B represents a waveform plot around a transient region and the process of detecting timing parameters for the transient in accordance with an embodiment of the invention.

FIG. 2B represents a waveform plot around a transient region and the process of detecting timing parameters for the transient in accordance with an embodiment of the invention. As exemplified above, transient 260 (represented in FIG. 2B at higher time resolution) shows a complex signal with a rising amplitude. Plot 270 represents the energy of the signal, obtained by converting the amplitude into an absolute value and computing a local average value. Line 272 represents a base level where the energy is zero (inactivity or silence). Line 272 may also represent a time axis. There is one line 272 associated with plot 270 and one line 272 associated with plot 280. Plot 280 represents a curve that further captures the shape of the envelope of energy around the transient. The latter representation may be constructed using a Bezier method, for example, or any other method that allows for representing curves. Embodiments of the invention may obtain amplitude information such as the maximum transient amplitude {e.g. 28*y*, or any other time related information from the transient representation. Time information may describe one or more aspects of the transient. For example, the system may determine an onset (e.g. 295) at which the energy level reaches a pre-determined (or pre-defined) threshold level (e.g. 286), the time of the maximum amplitude (e.g. 296), the time defined by the energy level reaching hat the maximum amplitude (e.g. 294), the time where the line of the rising slope intersects with the base line (e.g. 290, or any other time information that may provide accuracy of measurement of time references to characterize transients.

The threshold 286 may be set as constant value, or may be a measure from the signal, such as average amplitude of the local amplitude over a given time period, including a traveling frame associated with the current transient. Once local maxima and minima are located, other analyses, such as rise (or fall) time and slope may be utilized to precisely calculate a transient's timing parameters.

Figure 3:
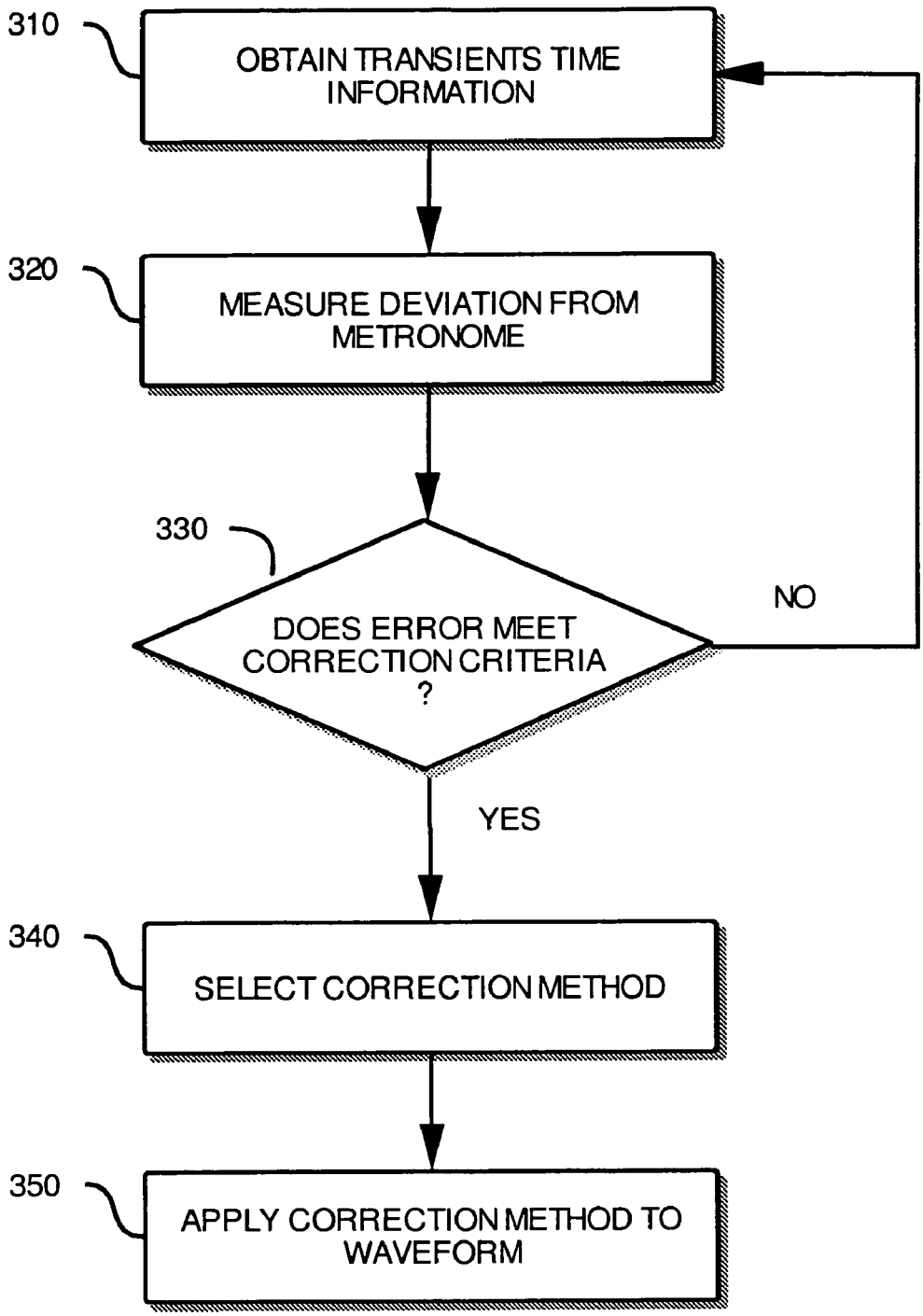
FIG. 3 is a flowchart illustrating steps involved in correcting rhythm deviations through use of a time source in accordance with embodiment of the invention.

FIG. 3 is a flowchart illustrating steps involved in correcting rhythm deviations through use of time source ticks in accordance with embodiment of the invention. A time source in embodiments of the invention may be embodied as computed time intervals following a clock such as a computer clock. The time source simulates ticks or a metronome, which indicates the time to be closely followed in order to produce enhanced rhythm. An embodiment of the invention may pre-analyze an audio signal to assess the optimal time for the audio data and configure the simulated time source with time intervals corresponding to the pre-determined periodicity. For example, an embodiment of the invention may sample a number of transients, determine time intervals separating the transients and compute an average time interval that may be used as a base period for the time reference.

At step 310, the system obtains timing information from transients in audio data (e.g. an audio data stream). Obtaining timing information from a transient may refer to the analysis performed on the data to determine when a data transient has occurred. For example, the system may determine that a transient occurred when the amplitude of the signal exceeds a pre-determined threshold. The system may also utilize other indicators such as the occurrence of a given frequency or a pattern thereof, which may indicate that a certain musical instrument is involved in keeping the music time, or any other cue that allows the system to detect the occurrence of a transient.

Because the onset of a transient may precede by any amount of time the point of threshold detection, the system may perform other types of computations in order to precisely determine timing parameters. For example, the system may compute the rising slope of the transient and determine the onset time of the transient as the intersection point between the slope straight line and the basis line of the signal. The system may also utilize the maximum amplitude of a transient as the time reference point, or any other derivative from that reference such as the half-maximum amplitude time that precedes the maximum amplitude time.

In other embodiments, transient timing information may already exist as metadata within the audio data file. For example, the transient timing information may have been determined in association with some other processing of the audio data and then added to the audio data file as metadata. Where the transient timing information is available from an existing source, such as the audio data file or an associated file, then timing information may be obtained from that source without further analysis of the audio waveform data.

At step 320, the deviation of the transient from the simulated time reference is measured. As illustrated in FIG. 2 (e.g. 240, 241, 242 and 243) the transients may occur with any time deviation from the optimal time reference. The system measures the deviation of a transient from its expected occurrence time. At step 330, the system may compare the computed deviation to one or more correction criteria. For example, a user may configure the system to correct for only those deviations that exceed a minimum value. If the deviation is within the accepted error margin (e.g. the error is imperceptible to the human ear), the system may ignore the deviation and continue the audio data processing (e.g. at step 310). Also, the system may be configured to ignore deviations that are greater than a maximum value, because the resulting artifacts would be too large. Embodiments of the invention may employ the minimum deviation approach, the maximum deviation approach, neither approach, or both approaches.

At step 340, a method of correcting the timing correction is selected. When the transient occurs with a delay, the correction involves compressing the region of data prior to the transient. When the transient occurred prior to its expected time (e.g. in comparison with a simulated metronome), the system may expand the region of data prior to the transient in order to delay the transient to match its expected occurrence time.

At step 350, the selected time correction method is applied to the waveform. Embodiments of the invention may utilize a number of methods to shift audio data in order to correct for the timing errors of transients. One approach is to shift the whole of the data set, as in a translation movement. In the latter case, the time correction is applied locally and succeeding data remain intact and available for processing as raw data. Another way of shifting the data involves determining a segment that undergoes a displacement. The latter case requires touching only a small subset of the audio data, but as can predicted, potentially, this may artificially introduce a timing error between the transient being corrected and the next one. Embodiments of the invention may take all of these considerations into account in choosing the appropriate method for correcting timing errors of transients.

It is well documented that altering an audio signal (e.g. by inserting data or deleting portions of data) creates discontinuities that generate unpleasant audible effects (artifacts). For example, when deleting a data portion, discontinuities may be created. Discontinuities in the time domain, of an abrupt nature, that are responsible for generating an audible spike, give rise to frequency domain errors that may lead to the emergence of high frequency artifact components in the signal. The expansion of an audio segment by repetition, on the other hand, may generate an unpleasant sound to the human ear.

Embodiments of the invention utilize a plurality of methods for correcting the signal. Some of those methods are described in greater detail in pending U.S. patent application Ser. No. 10/407,852, filed Apr. 4, 2003, the specification of which is incorporated herein by reference. An example of an artifact correction method is shown in FIGS. 4 and 5.

Figure 4A:
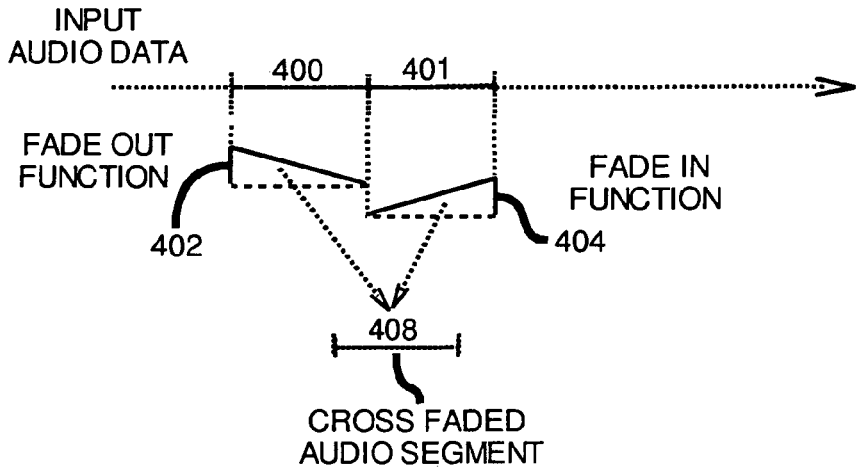
FIG. 4A illustrates the process of cross-fading utilized in accordance with an embodiment of the invention.
Figure 5:
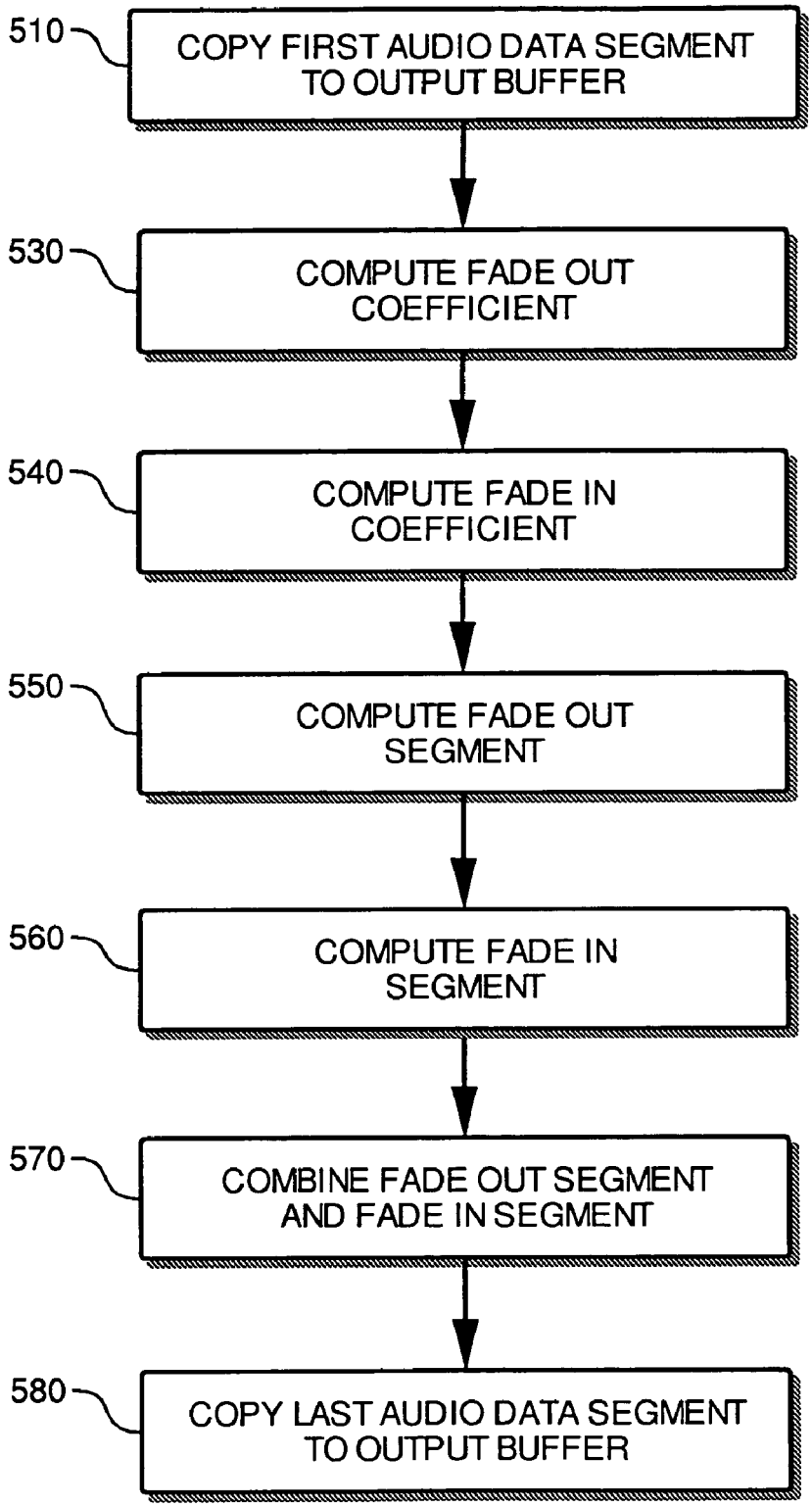
FIG. 5 is a flowchart diagram illustrating steps involved in cross-fading as used in embodiments of the invention.

FIG. 4A illustrates a cross-fading process utilized in accordance with an embodiment of the invention. Cross-fading refers to the process where the system mixes two audio segments, during which one segment is faded in and the second one A faded out The cross-fading process may utilize fade-in and fade-out functions, respectively. The two functions may be simple linear functions that linearly vary between one (1) and (zero). However, the fading function may utilize a square root fading function. An embodiment of the invention may utilize a linear function that approximates a square root function to reduce the computation time. The invention may utilize other "equal power" pats of functions (such as sine and cosine).

According to the cross-fading method, two overlapping or nonoverlapping data segments (e.g. 400 and 401), stored in an original memory buffer, are each combined (e.g. by multiplication) with a weighting fade-in or fade-out function (e.g. 402 and 404). Later by adding the result of the two combinations, the result is mixed audio data (e.g. 408) free of discontinuity artifacts.

Figure 4B:
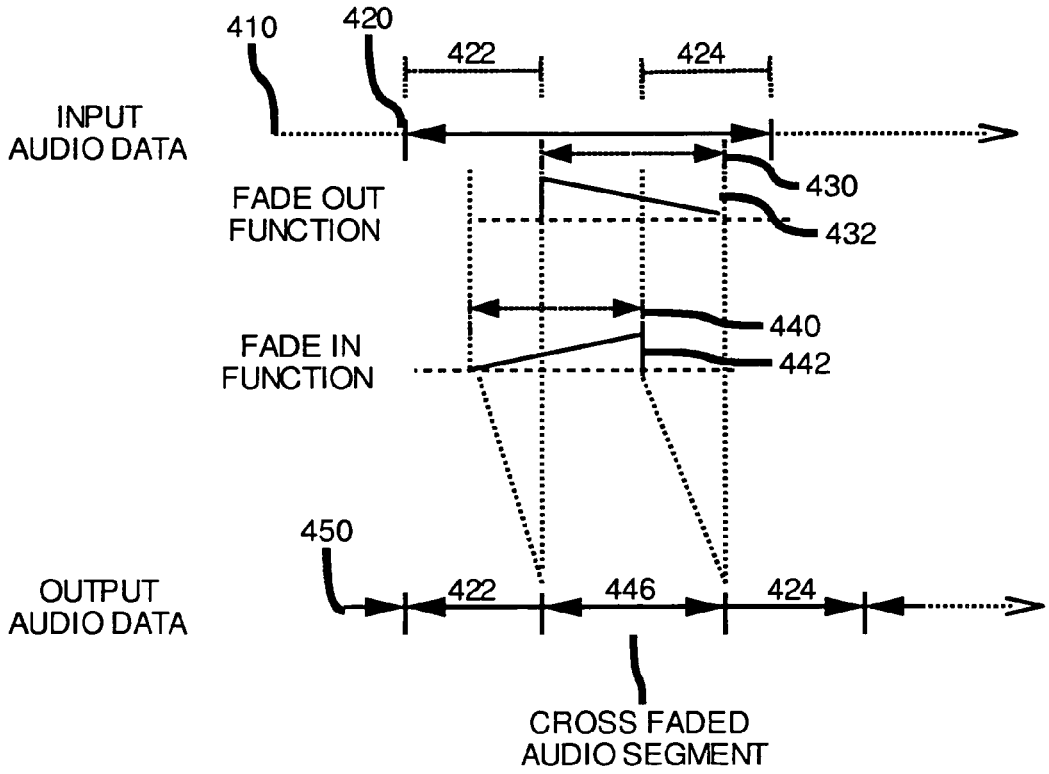
FIG. 4B illustrates an improved version of the basic cross-fade method utilizing a combination of cross-fading and copying in accordance with an embodiment of the invention.

FIG. 4B illustrates an improved version of the basic cross-fade method utilizing a combination of cross-fading and copying in accordance with an embodiment of the invention. Specifically, the system copies a portion of the beginning of the segment (e.g. 422, a middle portion is then cross-faded and a final portion (e.g. 424) is then copied, completing processing of the segment.

The system processes an input stream of audio data 410 in accordance with the detection methods described at step 210. The system divides the original audio signal 410 into short segments. In the example of FIG. 4, the system identifies a processing zone (e.g. starting at 420). The system may further analyze the processing zone and select one or more processing methods for expanding the audio data. After the data is processed, the system appends that data to an output buffer 450. In the example provided in FIG. 4, a first segment 422 and a second segment 424 are destined for copying without modification to the beginning and the end of the output buffer, respectively.

In FIG. 413, after the system copies segment 422 to the output buffer, the system cross-fades two segments 430 and 440. In the example of FIG. 4, Segment 422 is faded out while segment 424 is faded in.

For example, an audio signal is faded out (attenuated from full amplitude to silence) quickly (for example on the order of 0.03 seconds to 0.3 seconds) while the same audio signal is faded in from an earlier position, such that the end of the faded-in signal is delayed in time, thus making the audio signal appear to sound longer without altering the pitch K the sound. The division into segments is such that the beginning of each segment occurs at a regular rhythmic time interval. Each segment may represent an eighth note or sixteenth note, for example. The cross-fading method is detailed in U.S. Pat. No. 5,386,493, assigned to Apple Computer, Inc. and incorporated herein by reference.

FIG. 5 is a flowchart diagram illustrating steps involved in the crossfading as used in embodiments of the invention. At step 510, a system embodying the invention copies one or more unedited segments of audio data from the original buffer to an output buffer. When the system reaches a crossfading segment, it may compute a fade out coefficient, using one or more fading functions described above, at step 530. At step 540; the system computes the fade in coefficient. At step 550, the system computes the fade out segment For example, step 550 computes the product of a data sample from the original buffer segment 430, of FIG. 4, and a corresponding fade out coefficient in 432. At step 560, the system computes the fade in segment For example, step 560 computes the product of a data sample from the original buffer segment 440, of FIG. 4, and a corresponding fade out coefficient in 442.

At step 570, the fade out segment and the fade in segment are combined to produce the output cross-faded segment. Combining the two segments typically involves adding the faded segments. However, the system may utilize other techniques for combining the faded segments. At step 580, the system copies the remainder of the unedited segments to the output buffer.

Thus, a method and apparatus for altering audio data to evaluate and correct rhythm has been described. Embodiments of the invention provide a plurality of tools to detect transients in audio data, determine the correct time and eventually apply one or computation methods to locally enhance the rhythm in the audio data.

What is claimed is:

1. A method for enhancing rhythm in audio data comprising:

obtaining a preferred rhythm for an audio data stream;

identifying at least one event in said audio data stream; and, shifting said at least one event in time in accordance with said preferred rhythm.

2. The method of claim 1, wherein obtaining said preferred rhythm comprises obtaining a sampled periodicity using a plurality of amplitude events within said audio data steam.

3. The method of claim 1, wherein obtaining said preferred rhythm comprises calculating statistical distribution of inter-amplitude event time to determine a timing of notes and their sub-divisions within said audio data steam.

4. The method of claim 1, wherein obtaining said preferred rhythm comprises obtaining a user input to indicate said preferred rhythm.

5. The method of claim 1, wherein said audio data stream comprises analog audio data that represents audio from an analog source.

6. The method of claim 1, wherein said audio data stream comprises digital audio data that represent audio from a digital source.

7. The method of claim 1, wherein said identifying said at least one event comprises obtaining amplitude information from said audio stream.

8. The method of claim 1, wherein said identifying said at least one event comprises determining an event between a first amplitude and a second amplitude within said audio stream.

9. The method of claim 1, wherein said identifying said at least one event comprises obtaining a time of occurrence between a first amplitude and a second amplitude from within said audio stream.

10. The method of claim 9, wherein said time of occurrence comprises a time of peak activity.

11. The method of claim 9, wherein said time of occurrence comprises an onset time of said at least one event.

12. The method of claim 1, wherein said identifying said at least one event comprises obtaining pre-existing timing information of said at least one event.

13. The method of claim 1, wherein said shifting said at least one event comprises synchronizing said at least one event with said preferred rhythm.

14. The method of claim 13, wherein said shifting said at least one event further comprises expanding at least one data portion ahead of said at least one event within said audio data stream.

15. The method of claim 13, wherein said shifting said at least one event further comprises compressing at least one data portion ahead of said at least one event within said audio data stream.

16. The method of claim 13, wherein said shifting said at least one event further comprises expanding at least one data portion after said at least one event within said audio data stream.

17. The method of claim 13, wherein said shifting said at least one event further comprises compressing at least one data portion after said at least one event within said audio data stream.

18. The apparatus of claim 1, wherein obtaining said preferred rhythm comprises obtaining a sampled periodicity using a plurality of amplitude events within said audio data stream.

19. The apparatus of claim 1 wherein obtaining said preferred rhythm comprises calculating statistical distribution of inter-amplitude event time to determine a timing of notes and their sub-divisions within said audio data stream.

20. The apparatus of claim 1, wherein obtaining said preferred rhythm comprises obtaining a user input to indicate said preferred rhythm.

21. The apparatus of claim 1, wherein said audio data stream comprises analog audio data that represents audio from a digital source.

22. The apparatus of claim 1, wherein said audio data stream comprises digital audio data that represents audio from a digital source.

23. The apparatus of claim 1, wherein said identifying said at least one event comprises obtaining amplitude information form said audio stream.

24. The apparatus of claim 1, wherein said identifying said at least one event comprises determining an event between a first amplitude and a second amplitude within said audio stream.

25. The apparatus of claim 1, wherein said identifying said at least one event comprises obtaining a time of occurrence between a first amplitude and a second amplitude from within said audio stream.

26. The apparatus of claim 9, wherein said time of occurrence comprises a time of peak activity.

27. The apparatus of claim 9, wherein said time of occurrence comprises an onset time of said at least one event.

28. The apparatus of claim 1, wherein said identifying said at least one event comprises obtaining pre-existing timing information of said at least one event.

29. The apparatus of claim 1, wherein said shifting said at least one event comprises synchronizing said at least one event with said preferred rhythm.

30. The apparatus of claim 13, wherein said shifting said at least one event further comprises expanding at least one data portion ahead of said at least one event within said audio data stream.

31. The apparatus of claim 13, wherein said shifting said at least one event further comprises compressing at least one data portion ahead of said at least one event within said audio data stream.

32. The apparatus of claim 13, wherein said shifting said at least one event further comprises expanding at least one data portion after said at least one event within said audio data stream.

33. The apparatus of claim 13, wherein said shifting said at least one event further comprises compressing at least one data portion after said at least one event within said audio data stream.

34. A computer-readable storage medium carrying one or more sequences of instructions, wherein execution of the one or more sequences of instructions by one or more processors causes the one or more processors to perform the steps of:

obtaining a preferred rhythm time for an audio data stream;

identifying at least one event in said audio data stream; and, shifting said at least one event in time in accordance with said preferred rhythm.

35. The computer readable storage medium of claim 34, wherein obtaining said preferred rhythm comprises obtaining a sampled periodicity using a plurality of amplitude events within said audio data steam.

36. The computer readable storage medium of claim 34, wherein obtaining said preferred rhythm comprises calculating statistical distribution of inter-amplitude event time to determine a timing of notes and their sub-divisions within said audio data steam.

37. The computer readable storage medium of claim 34, wherein obtaining said preferred rhythm comprises obtaining a user input to indicate said preferred rhythm.

38. The computer readable storage medium of claim 34, wherein said audio data stream comprises analog audio data that represents audio from an analog source.

39. The computer readable storage medium of claim 34, wherein said audio data stream comprises digital audio data that represent audio from a digital source.

40. The computer readable storage medium of claim 34, wherein said identifying said at least one event comprises obtaining amplitude information from said audio stream.

41. The computer readable storage medium of claim 34, wherein said identifying said at least one event comprises determining an event between a first amplitude and a second amplitude within said audio stream.

42. The computer readable storage medium of claim 34, wherein said identifying said at least one event comprises obtaining a time of occurrence between a first amplitude and a second amplitude from within said audio stream.

43. The computer readable storage medium of claim 42, wherein said time of occurrence comprises a time of peak activity.

44. The computer readable storage medium of claim 42, wherein said time of occurrence comprises an onset time of said at least one event.

45. The computer readable storage medium of claim 34, wherein said identifying said at least one event comprises obtaining pre-existing timing information of said at least one event.

46. The computer readable storage medium of claim 34, wherein said shifting said at least one event comprises synchronizing said at least one event with said preferred rhythm.

47. The computer readable storage medium of claim 41, wherein said shifting said at least one event further comprises expanding at least one data portion ahead of said at least one event within said audio data stream.

48. The computer readable storage medium of claim 41, wherein said shifting said at least one event further comprises compressing at least one data portion ahead of said at least one event within said audio data stream.

49. The computer readable storage medium of claim 41, wherein said shifting said at least one event further comprises expanding at least one data portion after said at least one event within said audio data stream.

50. The computer readable storage medium of claim 41, wherein said shifting said at least one event further comprises compressing at least one data portion after said at least one event within said audio data stream.

51. A method for enhancing rhythm in audio data comprising:

computing rhythm parameters for audio data;

determining for any transient, the ideal expected time of occurrence based upon the rhythm parameters; and, shifting said transient based upon the ideal expected time of occurrence.

52. The method of claim 51, wherein computing rhythm parameters is performed automatically.

53. The method of claim 51, wherein shifting said transient comprises compressing the transient.

54. The method of claim 51, wherein shifting said transient comprises expanding the transient.

55. A method of enhancing rhythm in audio data comprising:

detecting timing errors between transients and a reference tick from a time source; and correcting the timing errors.

56. The method of claim 55, wherein correcting timing errors comprises determining whether the timing error exceeds a minimum value.

57. The method of claim 55, wherein correcting timing errors comprises determining whether the timing error exceeds a maximum value.

58. The method of claim 55, wherein correcting timing errors comprises shifting the whole of the audio data.

59. The method of claim 55, wherein correcting timing errors comprises displacing a segment of the audio data.

60. A new computer-readable storage medium carrying one or more sequences of instructions, wherein execution of the one or more sequences of instructions by one or more processors causes the one or more processors to perform the steps of:

computing rhythm parameters for audio data;

determining for any transient, the ideal expected time of occurrence based upon the rhythm parameters; and, shifting said transient based upon the ideal expected time of occurrence.

61. The new computer readable storage medium of claim 60, wherein computing rhythm parameters is performed automatically.

62. The computer readable medium of claim 60, wherein shifting said transient comprises compressing the transient.

63. The computer readable storage medium of claim 60, wherein shifting said transient comprises expanding the transient.

64. A computer-readable storage medium carrying one or more sequences of instructions, wherein execution of the one or more sequences of instructions by one or more processors causes the one or more processors to perform the steps of:

detecting timing errors between transients and a reference tick from a time source; and correcting the timing errors.

65. The computer readable storage medium of claim 64, wherein correcting timing errors comprises determining whether the timing error exceeds a minimum value.

66. The computer readable storage medium of claim 64, wherein correcting timing errors comprises determining whether the timing error exceeds a maximum value.

67. The computer readable storage medium of claim 64, wherein correcting timing errors comprises shifting the whole of audio data.

68. The computer readable storage medium of claim 64, wherein correcting timing errors comprises displacing a segment of audio data.

69. An apparatus for enhancing rhythm in audio data, comprising a computer-readable storage medium carrying one or more sequences of instructions, wherein execution of the one or more sequences of instructions by one or more processors causes the one or more processors to perform the steps of:

obtaining a preferred rhythm for an audio data stream;

identifying at least one event in said audio data stream; and, shifting said at least one event in time in accordance with said preferred rhythm.

* * * * *

UNITED STATES PATENT AND TRADEMARK OFFICE

CERTIFICATE OF CORRECTION

PATENT NO. : 7,250,566 B2
APPLICATION NO. : 11/497867
DATED : July 31, 2007
INVENTOR(S) : Lengeling et al.

It is certified that error appears in the above-identified patent and that said Letters Patent is hereby corrected as shown below:

Claim 19, column 9, line 13, after claim 1 insert a --,-- (comma) after 1

Claim 21, column 9, line 22, between "from" and "source" replace "a digital" with --an analog--

Claim 60, column 11, line 31, between "A" and "computer-readable" delete "new"

Claim 61, column 12, line 41, between "The" and "computer readable" delete "new"

Signed and Sealed this

Thirteenth Day of May, 2008

JON W. DUDAS
*Director of the United States Patent and Trademark Office*